US008646631B2

(12) United States Patent
Marchese et al.

(10) Patent No.: US 8,646,631 B2
(45) Date of Patent: Feb. 11, 2014

(54) KNUCKLE FORMED FROM PIVOT PIN AND KIDNEY CORE AND ISOLATED FINGER CORE

(75) Inventors: Thomas A. Marchese, Schaumburg, IL (US); Jerry R. Smerecky, Roselle, IL (US)

(73) Assignee: Bedloe Industries, LLC, Wilmington, DE (US)

( * ) Notice: Subject to any disclaimer, the term of this patent is extended or adjusted under 35 U.S.C. 154(b) by 0 days.

(21) Appl. No.: 13/466,576

(22) Filed: May 8, 2012

(65) Prior Publication Data

US 2012/0228256 A1 Sep. 13, 2012

Related U.S. Application Data

(62) Division of application No. 12/471,110, filed on May 22, 2009, now Pat. No. 8,201,613.

(60) Provisional application No. 61/055,459, filed on May 23, 2008, provisional application No. 61/055,805, filed on May 23, 2008.

(51) Int. Cl.
*B61G 3/00* (2006.01)

(52) U.S. Cl.
USPC ..... 213/155; 213/75 R; 213/137

(58) Field of Classification Search
USPC ..... 213/75 R, 155, 118, 140, 152, 156; 164/137, 340, 369–370
See application file for complete search history.

(56) References Cited

U.S. PATENT DOCUMENTS

| | | | |
|---|---|---|---|
| 450,947 | A | 4/1891 | Barnes |
| 491,174 | A | 2/1893 | Hazlehurst et al. |
| 892,563 | A | 7/1908 | Starbird |
| 1,346,224 | A | 7/1920 | McCormick |

(Continued)

FOREIGN PATENT DOCUMENTS

| | | | |
|---|---|---|---|
| BE | 524450 | A | 5/1954 |
| CA | 485408 | A | 8/1952 |

(Continued)

OTHER PUBLICATIONS

Armstrong Mold Corporation, "Precision Air-Set Sand Casting Process," retrieved Oct. 7, 2009, from http://www.armstrongmold.com/pages/airset.html, 2 pages.

(Continued)

*Primary Examiner* — Jason C Smith
(74) *Attorney, Agent, or Firm* — Nathan O. Greene; Brinks Gilson & Lione

(57) ABSTRACT

A railroad coupler knuckle includes a single, solid rib at a horizontal centerline of the knuckle that passes through a pivot pin hub thereof. The single, solid rib extends generally from a flag hole of a finger cavity of the knuckle to an opposite side of the knuckle from the flag hole. In another aspect, a railcar coupler knuckle includes a tail section, a hub section, and a nose section. The tail, hub, and nose sections define internal cavities including (i) a combined void that defines a pivot pin hub cavity and a kidney cavity and (ii) an isolated finger cavity. The combined void is formed using a first internal core during manufacturing of the coupler knuckle. The isolated finger cavity is formed using a second internal core during manufacturing of the coupler knuckle, such that molten alloy substantially separates the combined void and the isolated finger cavity.

7 Claims, 10 Drawing Sheets

(56) References Cited

U.S. PATENT DOCUMENTS 1,382,530 A 6/1921 Murphy
1,638,885 A 8/1927 Shea
1,758,235 A 5/1930 Nash
1,932,440 A 10/1933 Bazeley
1,966,765 A 7/1934 Murphy
2,039,086 A 4/1936 Kinne
2,088,135 A * 7/1937 Johnson et al. ..... 213/155
2,350,470 A 6/1944 Metzger
2,617,540 A * 11/1952 Metzger ..... 213/155
2,688,412 A * 9/1954 Kulieke ..... 213/155
2,709,007 A 5/1955 Metzger
2,760,652 A 8/1956 Blattner
2,769,556 A * 11/1956 Metzger ..... 213/127
2,909,293 A * 10/1959 Metzger ..... 213/146
2,948,414 A 8/1960 Metzger
2,959,299 A 11/1960 Metzger
2,997,755 A 8/1961 Olson
3,121,498 A 2/1964 Sudeck
3,168,202 A 2/1965 Cope
3,206,039 A 9/1965 Metzger
3,572,518 A 3/1971 Wisler
3,604,569 A 9/1971 Kulieke
3,613,902 A 10/1971 Altherr
3,627,145 A 12/1971 Altherr
3,635,356 A 1/1972 Shramovich
3,635,358 A 1/1972 Altherr
3,637,089 A 1/1972 Jwuc et al.
3,640,402 A 2/1972 Altherr et al.
3,670,901 A 6/1972 Metzger
3,675,787 A 7/1972 Krauskopf
3,698,570 A 10/1972 Metzger
3,698,571 A 10/1972 Hawthorne
3,717,261 A 2/1973 DePenti
3,722,708 A 3/1973 Ion et al.
3,735,877 A 5/1973 Bossong
3,767,062 A 10/1973 Holibaugh
3,779,397 A 12/1973 DePenti
3,833,131 A 9/1974 Altherr
3,850,311 A 11/1974 Kaufhold
3,850,312 A 11/1974 Baker, Sr.
3,853,228 A 12/1974 Metzger
3,854,599 A * 12/1974 Day et al. ..... 213/100 R
3,856,154 A 12/1974 DePenti
3,856,155 A 12/1974 Altherr
3,856,156 A 12/1974 Metzger
3,857,495 A 12/1974 Kaufhold
3,858,729 A 1/1975 Altherr
3,860,121 A 1/1975 Snell
3,872,978 A 3/1975 Altherr
3,881,602 A 5/1975 Altherr et al.
3,923,164 A 12/1975 Dalton
3,971,479 A 7/1976 DePenti
3,972,421 A 8/1976 DePenti
RE29,011 E 10/1976 Altherr
3,998,337 A 12/1976 Altherr
4,024,958 A * 5/1977 Kaufhold ..... 213/152
4,051,954 A 10/1977 Roberts
4,064,998 A 12/1977 Dilg et al.
4,081,082 A 3/1978 Scherrer et al.
4,084,704 A 4/1978 Metzger
4,084,705 A 4/1978 Oshinsky et al.
4,090,614 A 5/1978 Altherr et al.
4,090,615 A 5/1978 Martin
4,093,079 A 6/1978 Cope
4,119,209 A 10/1978 Jwuc
4,129,219 A 12/1978 Polanin
4,135,629 A 1/1979 Dilg et al.
4,143,701 A 3/1979 Oshinsky et al.
4,146,143 A 3/1979 Schelle
4,172,530 A 10/1979 Altherr et al.
4,206,849 A * 6/1980 Kaim ..... 213/151
4,230,228 A 10/1980 Kaim
4,245,747 A 1/1981 Roberts
4,258,628 A 3/1981 Altherr
4,267,935 A 5/1981 Dilg
4,287,834 A 9/1981 Zehnder et al.
4,316,549 A 2/1982 Klimowicz
4,333,576 A 6/1982 Kaim
4,363,414 A 12/1982 Kaim
4,391,380 A 7/1983 Hoose
4,398,641 A 8/1983 Klimowicz
4,426,012 A 1/1984 Adams, III et al.
4,438,854 A 3/1984 Baughman et al.
4,438,855 A 3/1984 Altherr
4,445,617 A 5/1984 Elliott
4,452,299 A 6/1984 Gruber et al.
4,466,546 A 8/1984 Altherr et al.
4,474,732 A 10/1984 Lynn
4,480,758 A 11/1984 Hurt et al.
4,585,133 A 4/1986 Cope
4,595,109 A 6/1986 McClurg
4,605,133 A * 8/1986 Altherr ..... 213/155
4,637,518 A 1/1987 Hanula
4,640,422 A 2/1987 Elliott
4,645,085 A 2/1987 Hanula et al.
4,706,826 A 11/1987 Elliott et al.
4,776,474 A 10/1988 Terlecky et al.
4,811,854 A * 3/1989 Elliott ..... 213/155
4,848,611 A 7/1989 Terlecky et al.
4,927,035 A 5/1990 Geng et al.
4,976,362 A 12/1990 Kaufhold
4,976,363 A * 12/1990 Altherr ..... 213/155
4,982,781 A 1/1991 Carpenter et al.
4,984,696 A 1/1991 Altherr
5,050,751 A 9/1991 Thrift et al.
5,139,161 A 8/1992 Long
5,145,076 A 9/1992 Murphy et al.
5,285,911 A 2/1994 Altherr
5,305,899 A 4/1994 Kaufhold
5,312,007 A 5/1994 Kaufhold et al.
5,415,304 A 5/1995 Hanes et al.
5,424,376 A 6/1995 Chang et al.
5,427,257 A 6/1995 Hanes et al.
5,479,981 A 1/1996 Kim
5,482,675 A 1/1996 Shotwell et al.
D369,756 S 5/1996 Noel
5,582,307 A * 12/1996 Hawthorne et al. ..... 213/109
5,630,519 A 5/1997 Burke et al.
5,833,086 A 11/1998 Kaufhold
5,878,897 A 3/1999 Lazzaro et al.
5,915,451 A 6/1999 Nakamura
5,927,522 A 7/1999 Carifa
5,954,212 A * 9/1999 Beatty et al. ..... 213/155
6,005,021 A 12/1999 Chen et al.
6,062,406 A 5/2000 Duncan
6,129,227 A * 10/2000 Openchowski et al. ..... 213/111
6,148,733 A 11/2000 Gagliardino
6,206,215 B1 3/2001 Maa
6,237,785 B1 5/2001 Daugherty, Jr.
6,360,906 B1 3/2002 Kaufhold et al.
6,446,820 B1 9/2002 Barker et al.
6,488,163 B1 12/2002 Wurzer et al.
6,588,490 B2 7/2003 Rommel et al.
6,681,943 B2 1/2004 Barker et al.
6,758,919 B2 7/2004 Milligan
6,783,610 B2 8/2004 Shirley et al.
6,796,448 B1 9/2004 Wilt et al.
6,944,925 B2 9/2005 Brueckert et al.
7,020,977 B2 4/2006 Brueckert et al.
7,059,062 B2 6/2006 Brueckert et al.
7,143,522 B2 12/2006 Brueckert et al.
7,171,734 B2 2/2007 Brueckert et al.
7,171,758 B2 2/2007 Brueckert et al.
7,302,994 B2 * 12/2007 Mautino et al. ..... 164/137
7,337,826 B2 3/2008 Mautino et al.
7,360,318 B2 4/2008 Brueckert et al.
8,196,762 B2 6/2012 Smerecky
8,201,613 B2 6/2012 Marchese et al.
2002/0007931 A1 1/2002 Crafton et al.
2003/0127412 A1 7/2003 Mautino et al.
2003/0221811 A1 12/2003 Smith et al.
2004/0173555 A1 9/2004 Wilt et al.
2005/0160581 A1 7/2005 Brueckert et al.
2005/0160582 A1 7/2005 Brueckert et al.

(56) References Cited

U.S. PATENT DOCUMENTS

| | | | | |
|---|---|---|---|---|
| 2005/0160584 | A1 | 7/2005 | Brueckert et al. | |
| 2005/0184021 | A1 | 8/2005 | Mautino et al. | |
| 2006/0113267 | A1 | 6/2006 | Mautino et al. | |
| 2007/0084818 | A1 | 4/2007 | Brabb et al. | |
| 2007/0125510 | A1* | 6/2007 | Mautino et al. | 164/137 |
| 2007/0130773 | A1 | 6/2007 | Brueckert et al. | |
| 2008/0083690 | A1* | 4/2008 | Mautino et al. | 213/152 |
| 2009/0289021 | A1 | 11/2009 | Smerecky et al. | |
| 2009/0289022 | A1 | 11/2009 | Smerecky et al. | |
| 2009/0289023 | A1* | 11/2009 | Marchese et al. | 213/155 |
| 2009/0289024 | A1 | 11/2009 | Nibouar et al. | |
| 2009/0294395 | A1* | 12/2009 | Smerecky | 213/155 |
| 2009/0294396 | A1 | 12/2009 | Smerecky et al. | |
| 2011/0168655 | A1 | 7/2011 | Nibouar et al. | |
| 2012/0228256 | A1* | 9/2012 | Marchese et al. | 213/155 |

FOREIGN PATENT DOCUMENTS

| | | | |
|---|---|---|---|
| CA | 510469 | A | 3/1955 |
| CA | 540837 | A | 5/1957 |
| CA | 547137 | A | 10/1957 |
| CA | 753964 | A | 3/1967 |
| CA | 905353 | A | 7/1972 |
| CA | 1022116 | A1 | 12/1977 |
| CA | 1034085 | A1 | 7/1978 |
| CA | 1039683 | A1 | 10/1978 |
| CA | 1041050 | A1 | 10/1978 |
| CA | 1045085 | A1 | 12/1978 |
| CA | 1079234 | A1 | 6/1980 |
| CA | 1087135 | A1 | 10/1980 |
| CA | 1089808 | A1 | 11/1980 |
| CA | 1093021 | A1 | 1/1981 |
| CA | 1098869 | A1 | 4/1981 |
| CA | 1108560 | A1 | 9/1981 |
| CA | 1195660 | A1 | 10/1985 |
| CA | 1226244 | A1 | 9/1987 |
| CA | 1251170 | A1 | 3/1989 |
| CA | 2027987 | A1 | 5/1991 |
| CA | 2054390 | A1 | 5/1992 |
| CA | 2171030 | A1 | 11/1996 |
| CA | 2260658 | A1 | 9/1999 |
| CA | 2395875 | A1 | 7/2003 |
| CA | 2573306 | A1 | 2/2006 |
| CN | 101010231 | A | 8/2007 |
| CN | 101402131 | A | 4/2009 |
| EP | 1531018 | A1 | 5/2005 |
| GB | 185657 | A | 9/1922 |
| GB | 221691 | A | 9/1924 |
| GB | 326575 | A | 3/1930 |
| GB | 355247 | A | 8/1931 |
| GB | 743098 | A | 1/1956 |
| GB | 902971 | A | 8/1962 |
| GB | 1477368 | A | 6/1977 |
| GB | 2292899 | A | 3/1996 |
| GB | 2300611 | A | 11/1996 |
| WO | WO 01/81024 | A1 | 11/2001 |
| WO | WO 2006/017412 | A1 | 2/2006 |
| WO | WO 2009/142746 | A1 | 11/2009 |
| WO | WO 2009/142747 | A1 | 11/2009 |
| WO | WO 2009/142748 | A1 | 11/2009 |
| WO | WO 2009/142749 | A1 | 11/2009 |
| WO | WO 2009/142750 | A1 | 11/2009 |
| WO | WO 2009/142757 | A1 | 11/2009 |
| WO | WO 2011/084992 | A1 | 7/2011 |

OTHER PUBLICATIONS

Bernier Cast Metals Inc., "Air-Set (No Bake) Process," retrieved Oct. 7, 2009, from http://www.bernierinc.com/AirSet.html, 1 page.
Bernier Cast Metals Inc., "Green Sand Molding," retrieved Oct. 7, 2009, from http://www.bernierinc.com/GreenSandMolding.html, 1 page.
Butler Foundry, "Air Set Casting," retrieved Oct. 7, 2009, from http://www.foundrycasting.co.uk/air-set-casting.html, 2 pages.
Custom PartNet, "Sand Casting," retrieved Oct. 7,2009, from http://www.custompartnet.com/wu/SandCasting, 7 pages.
International Preliminary Report on Patentability for International Application No. PCT/US2009/003154, dated Nov. 23, 2010, 8 pages.
International Preliminary Report on Patentability for International Application No. PCT/US2009/003155, dated Nov. 23, 2010, 7 pages.
International Preliminary Report on Patentability for International Application No. PCT/US2009/003157, dated Nov. 23, 2010, 8 pages.
International Preliminary Report on Patentability for International Application No. PCT/US2009/003158, dated Nov. 23, 2010, 9 pages.
International Preliminary Report on Patentability for International Application No. PCT/US2009/003159, dated Nov. 23, 2010, 8 pages.
International Preliminary Report on Patentability for International Application No. PCT/US2009/003170, dated Nov. 23, 2010, 9 pages.
International Search Report for International Application No. PCT/US2009/003154, dated Sep. 3, 2009, 3 pages.
International Search Report for International Application No. PCT/US2009/003155, dated Aug. 27, 2009, 3 pages.
International Search Report for International Application No. PCT/US2009/003157, dated Sep. 10, 2009, 3 pages.
International Search Report for International Application No. PCT/US2009/003158, dated Aug. 27, 2009, 2 pages.
International Search Report for International Application No. PCT/US2009/003159, dated Aug. 31, 2009, 3 pages.
International Search Report for International Application No. PCT/US2009/003170, dated Sep. 1, 2009, 3 pages.
International Search Report for International Application No. PCT/US2011/020207, dated Apr. 15, 2011, 2 pages.
Office Action from co-pending U.S. Appl. No. 12/470,883, dated Mar. 2, 2011, 8 pages.
Office Action from co-pending U.S. Appl. No. 12/470,883, dated Sep. 21, 2011, 8 pages.
Office Action from co-pending U.S. Appl. No. 12/470,883, dated Apr. 13, 2012, 11 pages.
Office Action from co-pending U.S. Appl. No. 12/470,915, dated Feb. 16, 2011, 8 pages.
Office Action from co-pending U.S. Appl. No. 12/470,915, dated Nov. 15, 2011, 17 pages.
Office Action from co-pending U.S. Appl. No. 12/471,029, dated Feb. 16, 2011, 9 pages.
Office Action from co-pending U.S. Appl. No. 12/471,029, dated Oct. 26, 2011, 14 pages.
Office Action from co-pending U.S. Appl. No. 12/471,053, dated Mar. 21, 2011, 12 pages.
Office Action from co-pending U.S. Appl. No. 12/471,053, dated Dec. 7, 2011, 20 pages.
Notice of Allowance from co-pending U.S. Appl. No. 12/471,053, dated Mar. 30, 2012, 7 pages.
Office Action from co-pending U.S. Appl. No. 12/471,136, dated Jun. 21, 2011, 9 pages.
Office Action from co-pending U.S. Appl. No. 12/471,136, dated Dec. 2, 2011, 20 pages.
Office Action from co-pending U.S. Appl. No. 12/471,136, dated May 9, 2012, 9 pages.
Office Action from co-pending U.S. Appl. No. 12/471,136, dated Jul. 24, 2012, 8 pages.
Office Action from co-pending U.S. Appl. No. 12/685,346, dated Aug. 16, 2011, 7 pages.
Office Action from co-pending U.S. Appl. No. 12/685,346, dated May 8, 2012, 7 pages.
Office Action from co-pending U.S. Appl. No. 12/685,346, dated Jul. 27, 2012, 7 pages.
SCRATA Specifications Committee, "Comparators for the Definition of Surface Quality of Steel Castings," publication date unknown, 32 pages.
SFSA Supplement 3, "Dimensional Capabilities of Steel Castings," retrieved Jan. 12, 2010, from www.sfsa.org/sfsa/pubs/hbk/s3.pdf, 33 pages.
Transactions of the American Foundrymen's Society, Proceedings of the Ninety-first Annual Meeting, Apr. 5-10, 1987. vol. 95, 21 pages.
Unknown Author, "A.R.A. Type "E" Coupler," Railway Mechanical Engineer, May 1932, pp. 207-208.

(56) References Cited

OTHER PUBLICATIONS

Unknown Author, "Report on Couplers and Draft Gears," Railway Mechanical Engineer, Jul. 1933, pp. 243-244.
Unknown Author, "Steel Castings Handbook," 6th Edition, Steel Founders' Society of America, © 1995, 3 pages.
Walton, Charles F. et al., "Iron Castings Handbook," Iron Castings Society, Inc., © 1981, 5 pages.
Wikipedia, "Chill (casting)," retrieved Oct. 7, 2009, from http://en.wikipedia.org/wiki/Chill_(foundry), 2 pages.
Wikipedia, "Cope and drag," retrieved Oct. 7, 2009, from http://en.wikipedia.org/wiki/Cope_and_drag, 1 page.
Wikipedia, "Flask (casting)," retrieved Oct. 7, 2009, from http://en.wikipedia.org/wiki/Casting_flask, 1 page.
Wikipedia, "Molding sand," retrieved Oct. 7, 2009, from http://en.wikipedia.org/wiki/Molding_sand, 1 page.
Wikipedia, "No bake mold casting," retrieved Oct. 7, 2009, from http://en.wikipedia.org/wiki/No_bake_mold_casting, 2 pages.
Wikipedia, "Sand Casting," retrieved Oct. 7, 2009, from http://en.wikipedia.org/wiki/Sand_casting, 10 pages.
International Preliminary Report on Patentability for International Application No. PCT/US2011/020207, dated Dec. 16, 2011 (7 pages).
Examiner's Report for Canadian Application No. 2,725,288, dated Mar. 1, 2012 (3 pages).
International Search Report and Written Opinion for International Patent Application No. PCT/US2010/062574, dated May 30, 2011 (13 pages).
International Search Report for International Application No. PCT/US2012/037907, dated Aug. 30, 2012 (13 pages).
International Search Report for International Application No. PCT/US2012/037879, dated Aug. 30, 2012 (13 pages).
International Search Report for International Application No. PCT/US2012/037952, dated May 15, 2012 (15 pages).
International Search Report for International Application No. PCT/US2012/037949, dated May 15, 2012 (14 pages).
Office Action for Chinese Application No. 200980123762.8, dated Sep. 26, 2012 (15 pages).
Office Action for Chinese Application No. 200980122327.3, dated Sep. 27, 2012 (13 pages).
Office Action from co-pending U.S. Appl. No. 12/471,110, dated Mar. 17, 2011 (11 pages).
Office Action from co-pending U.S. Appl. No. 12/471,110, dated Nov. 30, 2011 (13 pages).
Office Action from co-pending U.S. Appl. No. 12/471,110, dated Mar. 14, 2012 (7 pages).
Notice of Allowance from co-pending U.S. Appl. No. 12/471,110, dated Apr. 5, 2012 (8 pages).

* cited by examiner

SECTION D-D

KNUCKLE FORMED FROM PIVOT PIN AND KIDNEY CORE AND ISOLATED FINGER CORE

RELATED APPLICATIONS

This application is a divisional application of U.S. patent application Ser. No. 12/471,110, filed May 22, 2009 and entitled "Knuckle Formed From Pivot Pin and Kidney Core and Isolated Figure Core," now U.S. Pat. No. 8,201,613, which claims priority to U.S. Provisional Patent Application Nos. 61/055,459 and 61/055,805, both filed on May 23, 2008. All three applications are incorporated herein by this reference in their entireties.

BACKGROUND

1. Technical Field

The present embodiments relate generally to the field of railroad couplers, and more specifically, to the manufacturing of a railway coupler knuckle.

2. Related Art

Railcar couplers are disposed at each end of a railway car to enable joining one end of such railway car to an adjacently disposed end of another railway car. The engageable portion of each of these couplers is known in the railway art as a knuckle.

Typically a knuckle is manufactured with three cores, commonly referred to as a finger core in the front portion of the knuckle, pivot pin core in the center of the knuckle, and a kidney core at the rear of a knuckle. The finger core and kidney core reduce the weight of the knuckle. Still, knuckles can weigh about 80 pounds, and must be carried from the locomotive at least part of the length of the train during replacement. This distance can be anywhere from 25 up to 100 or more railroad cars in length.

Coupler knuckles are generally manufactured from cast steel using a mold and the three cores. During the casting process itself, the interrelationship of the mold and three cores disposed within the mold are critical to producing a satisfactory railway freight car coupler knuckle. Many knuckles fail from internal and/or external inconsistencies in the metal through the knuckle. If one or more cores move during the casting process, then some knuckle walls may end up thinner than others resulting in offset loading and increased failure risk during use of the knuckle.

Furthermore, multiple thin ribs have been located within a front face section associated with a finger cavity at the front of the knuckle. These multiple, thin ribs are known to be a source of premature failure of the couple knuckles so designed.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like-referenced numerals designate corresponding parts throughout the different views.

DETAILED DESCRIPTION

In some cases, well known structures, materials, or operations are not shown or described in detail. Furthermore, the described features, structures, or characteristics may be combined in any suitable manner in one or more embodiments. It will also be readily understood that the components of the embodiments as generally described and illustrated in the Figures herein could be arranged and designed in a wide variety of different configurations.

Referring to FIGS. 1-4, the present embodiments of a railroad coupler knuckle combines a pivot pin core 10 and a kidney core 12 into a first core. A second core is an isolated finger core 14, seen best in FIG. 3 with a unique shape having a large core footprint. The enlarged core footprint improves stabilization of the finger core 14 within the cope and drag mold portions (FIG. 14) during the molding process. Accordingly, the improved stabilization helps to prevent movement during the molding process, thereby helping to insure the intended wall thicknesses, which improves the strength and fatigue life of the coupler knuckle.

Figure 1:
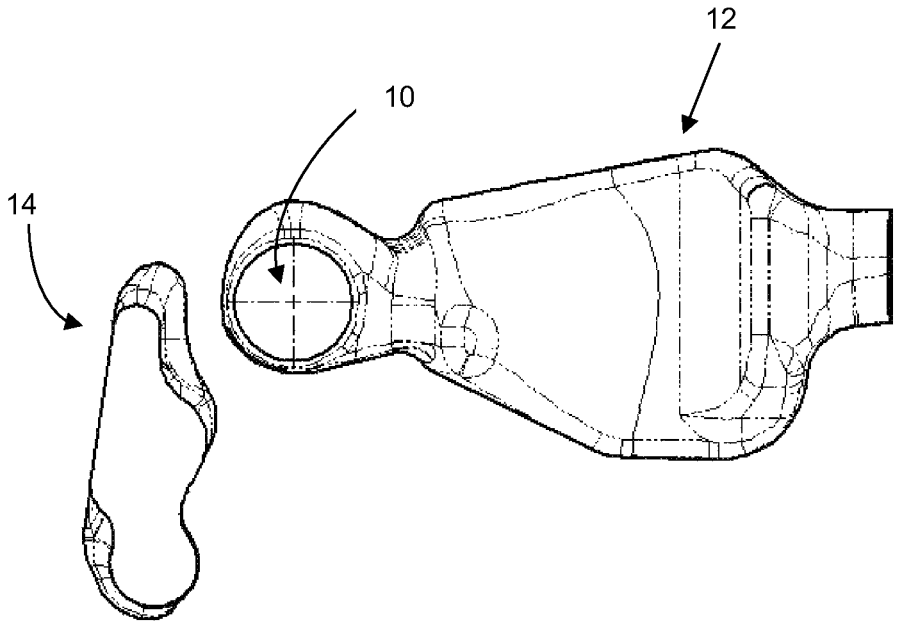
FIG. 1 is a top view of the knuckle cores with the finger core isolated from the pivot pin and kidney core.
Figure 2:
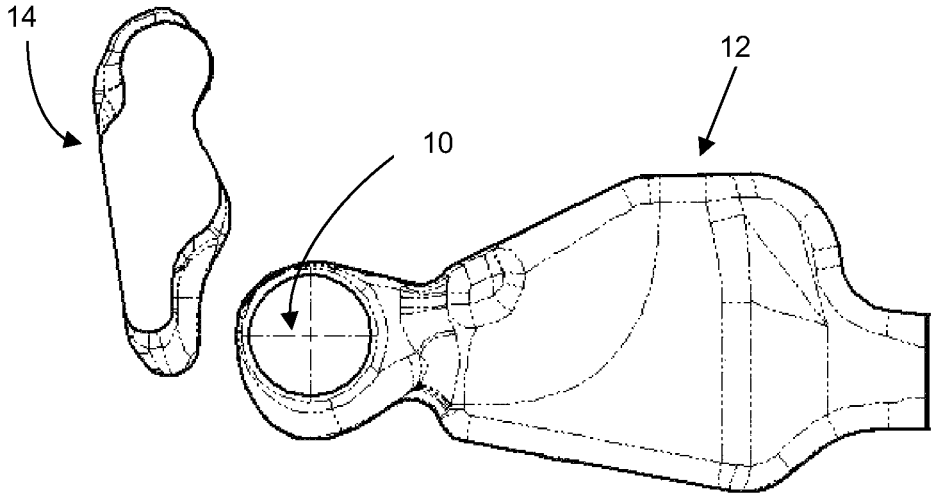
FIG. 2 is a bottom view of the knuckle cores of FIG. 1.
Figure 3:
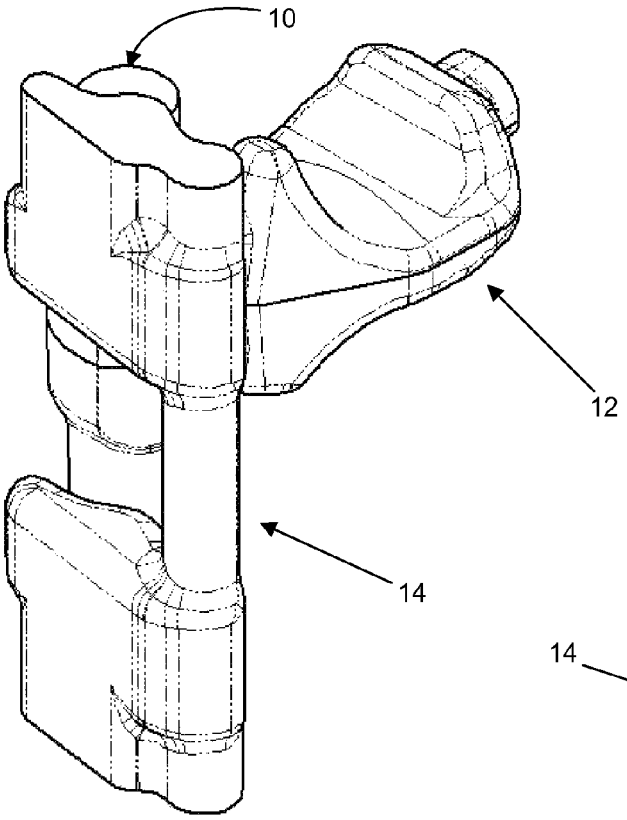
FIGS. 3 and 4 are perspective views of the two cores used to form the knuckles of FIGS. 5 and 6, in spatial relationship before the molds are poured.
Figure 4:
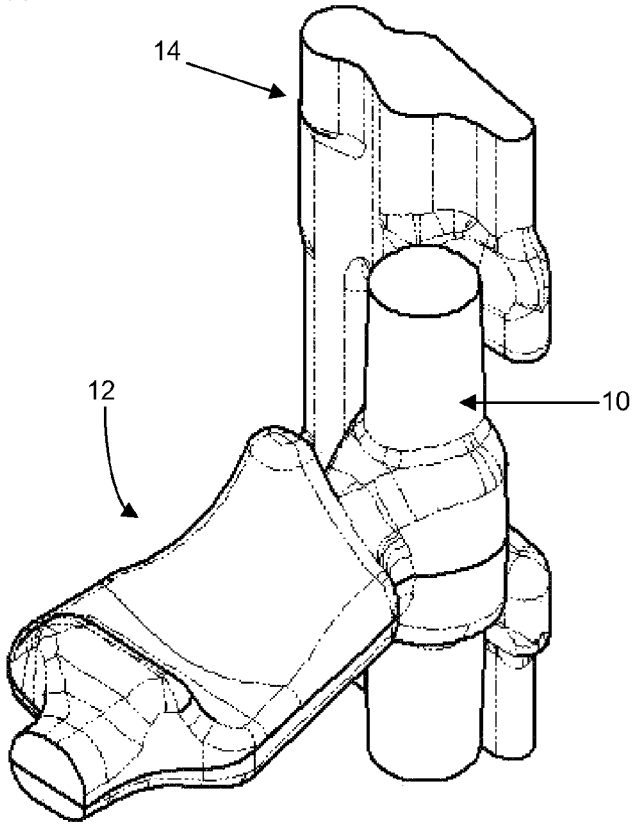
Figure 5:
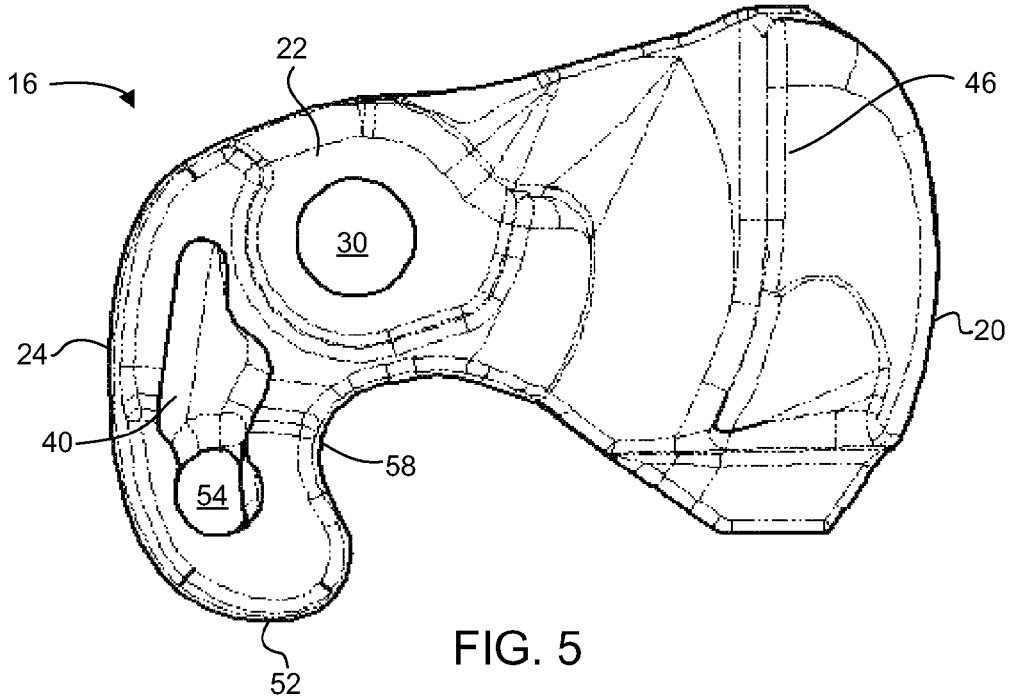
FIG. 5 is a top view of a knuckle after molding with use of the knuckle cores of FIGS. 1-4.
Figure 6:
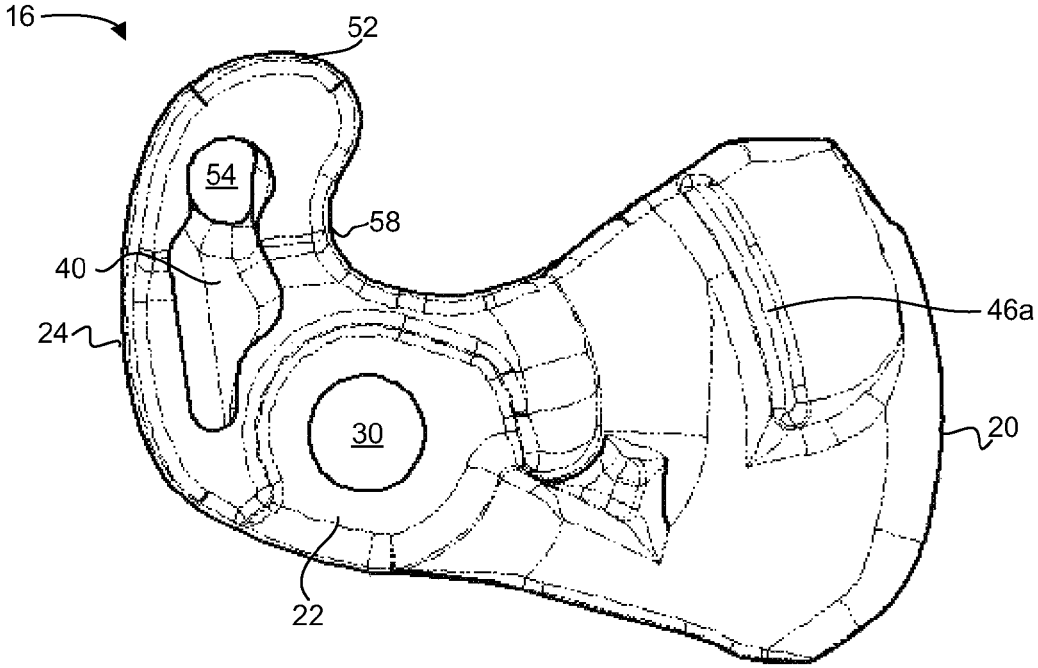
FIG. 6 is a bottom view of the knuckle after molding with use of the knuckle cores of FIGS. 1-4.

FIGS. 5 and 6 are, respectively, top and bottom views of a coupler knuckle 16 after molding with use of the knuckle cores 10, 12, 14 of FIGS. 1-4. The coupler knuckle 16 includes a tail section 20, a hub section 22 and a front face section 24. The hub section 22 includes a pivot pin hole 30 formed therein for receiving a pivot pin to pivotally couple the knuckle 16 to a coupler for coupling to a railcar. The pivot pin hole 30 is formed from at least a portion of the first core (10, 12). The pivot pin hole 30 is generally cylindrical. The knuckle 16 also includes a finger cavity 40 in the front face section created with the isolated finger core 14 during molding. The coupler knuckle 16 also includes a top pulling lug 46 and bottom pulling lug **46*a* used to pull the knuckle 16** when attached to the train.

The front face section 24 includes a nose section 52, which includes a generally cylindrical flag hole 54 opening formed in an end region of the nose section 52. A pulling face portion 58 is disposed inwardly from nose section 52, at least a portion of which bears against a similar surface of a coupler knuckle of an adjacent railcar to couple the railcars together as shown in FIG. 12.

Figure 7:
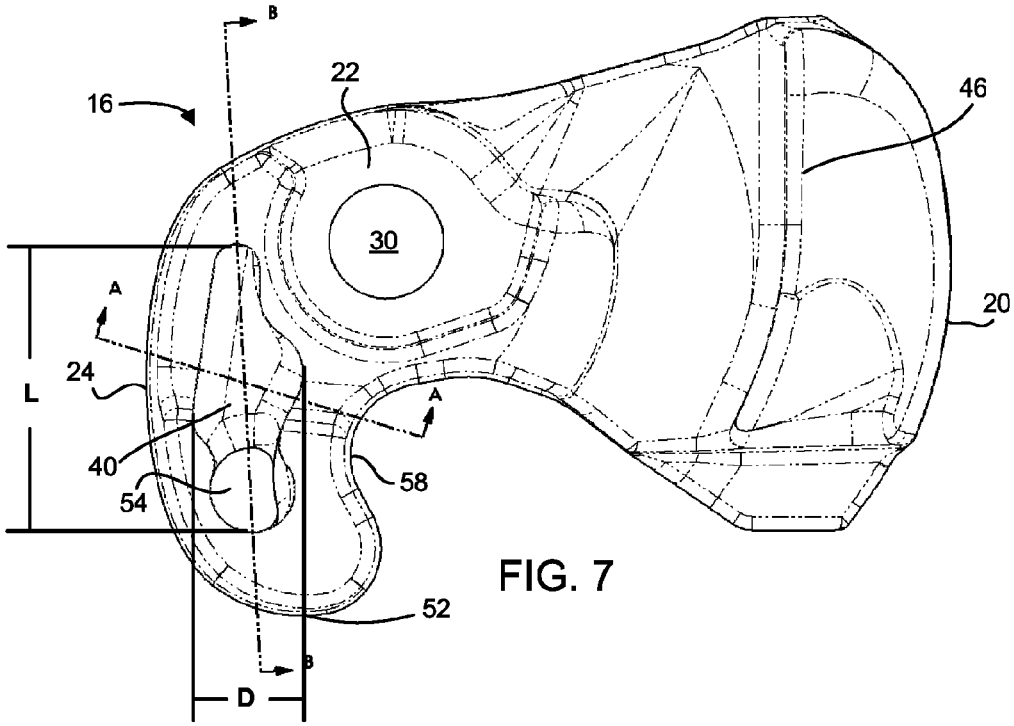
FIG. 7 is a top view of the knuckle, indicating cross section views along lines A-A and B-B through the finger cavity of the knuckle of FIGS. 5-6, and showing dimensions of the finger core support holes.
Figure 8:
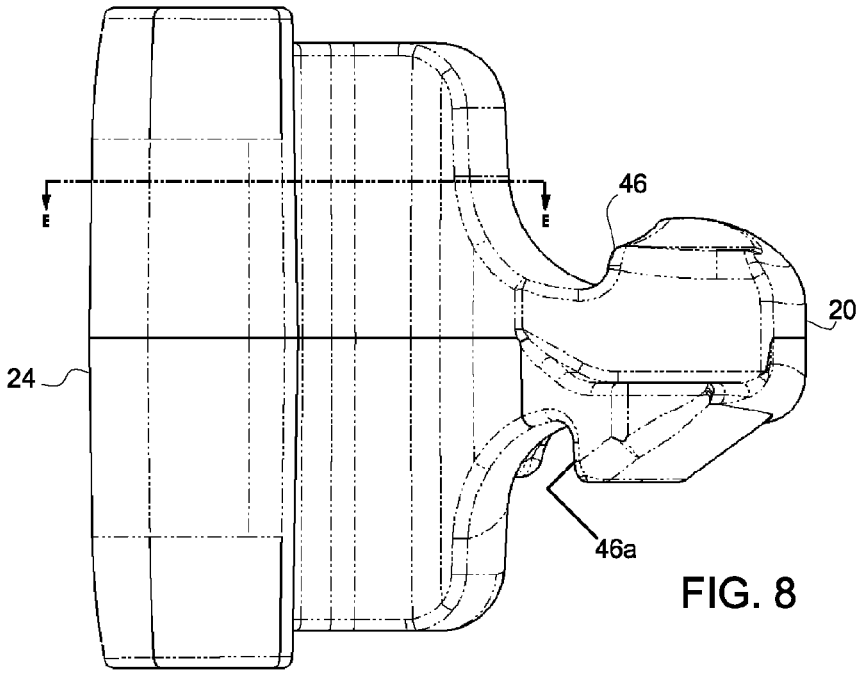
FIG. 8 is a side view of FIG. 7, indicating a cross section view alone line E-E.

FIG. 7 is a top view of the knuckle 16, indicating cross section views along lines A-A and B-B through the finger cavity 40 of the knuckle of FIGS. 5-6, and showing dimensions of the finger core support holes. In one embodiment, the depth D and length L of the cross section of the finger cavity 40 are approximately 1.6" and 4.3", respectively, as shown in FIG. 7. Alternative dimensions are envisioned, as would be apparent to one skilled in the art of railroad couplers. FIG. 8 is a side view of FIG. 7, indicating a cross section view alone line E-E.

Figure 9:
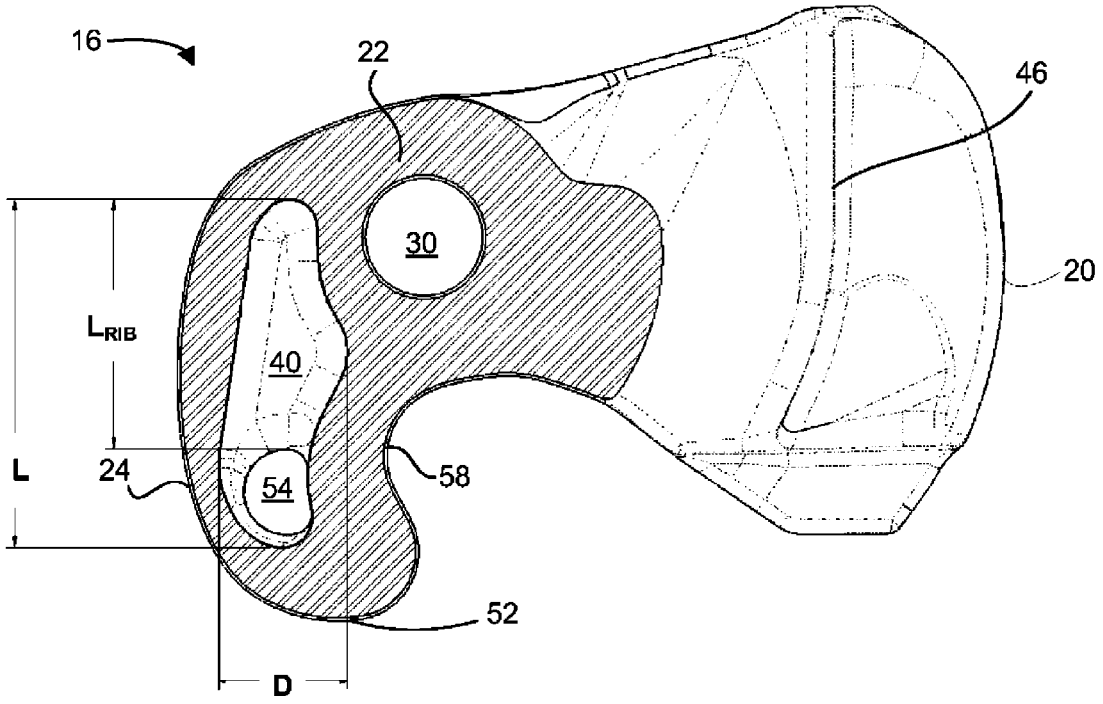
FIG. 9 is the section view along line E-E of the knuckle of FIG. 8, showing dimensions of a continuous, solid, uninterrupted, thick rib located along a horizontal centerline of the knuckle that passes through the pivot pin section hub.
Figure 10:
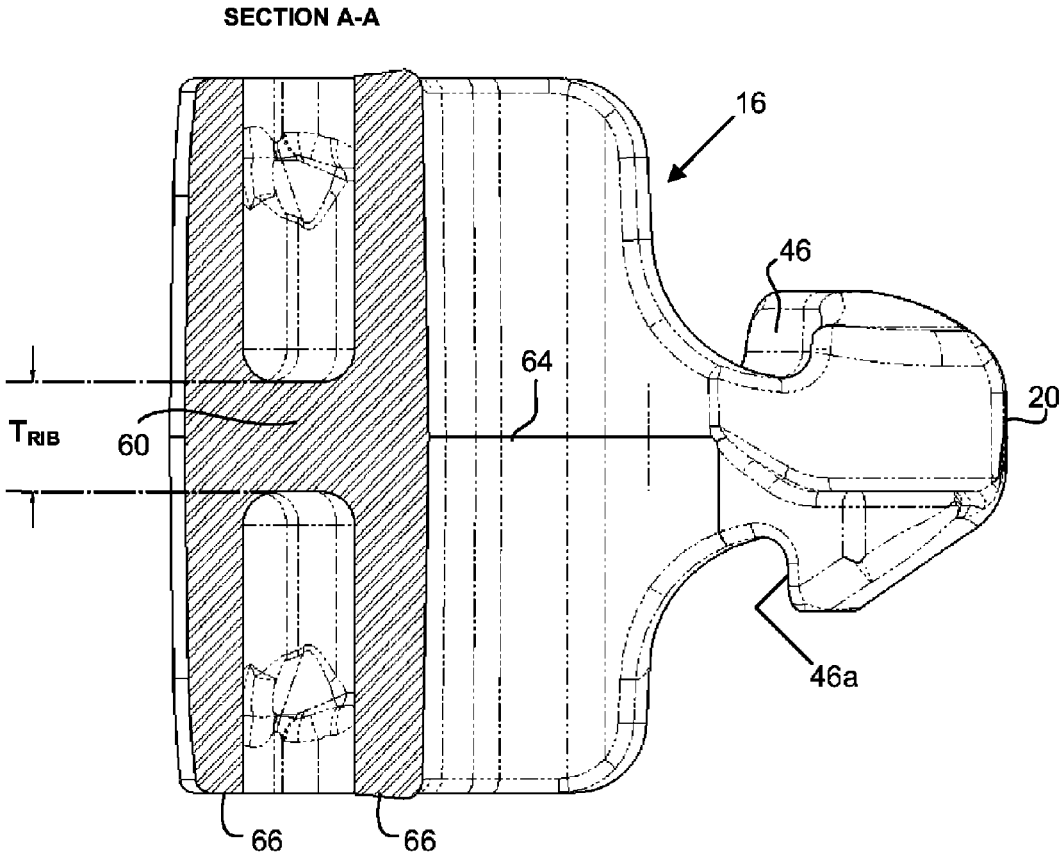
FIG. 10 is the cross section view along line A-A of FIG. 7, indicating the thickness of the continuous, solid, uninterrupted thick rib located along a horizontal centerline of the knuckle that passes through the pivot pin section hub.
Figure 11:
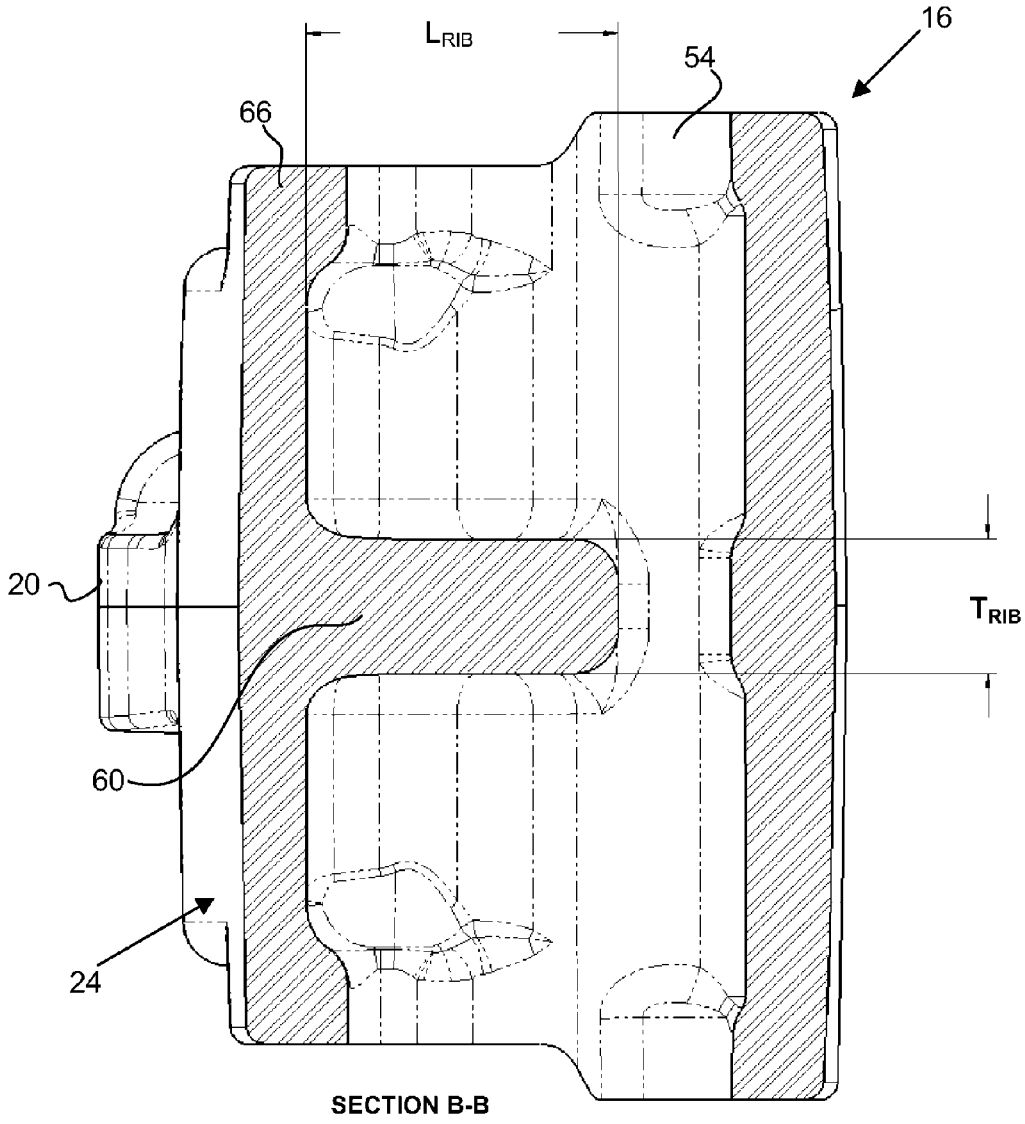
FIG. 11 is a front, cross section view along line B-B of the knuckle of FIG. 7.

As shown in FIGS. 9-11, the finger core 14 is designed to create within the finger cavity 40 a single, continuous, solid, uninterrupted thick rib 60 located along a horizontal centerline 64 of the knuckle 16 that passes through the pivot pin hub section 22. A pair of side fins (or walls) 66 are attached to the thick rib 60 and extend along the front face section 24. The single, thick rib 60 replaces the multiple thin ribs of prior art knuckles, thus aiding in prevention of premature knuckle failure due to break down of the multiple thin ribs. The single, thick rib 60 may extend from the flag hole 54 to the other side of the knuckle 16, as best seen in FIG. 11, wherein the single, thick rib 60 may connect with the pivot pin hub 22. As shown in FIGS. 9-11, the single, thick rib 60 may have a length $L_{RIB}$ of about 3.6", a depth of about 1.9", and a thickness $T_{RIB}$ of about 1.5" in one embodiment. Alternative dimensions are envisioned, as would be apparent to one skilled in the art of railroad couplers.

Figure 12:
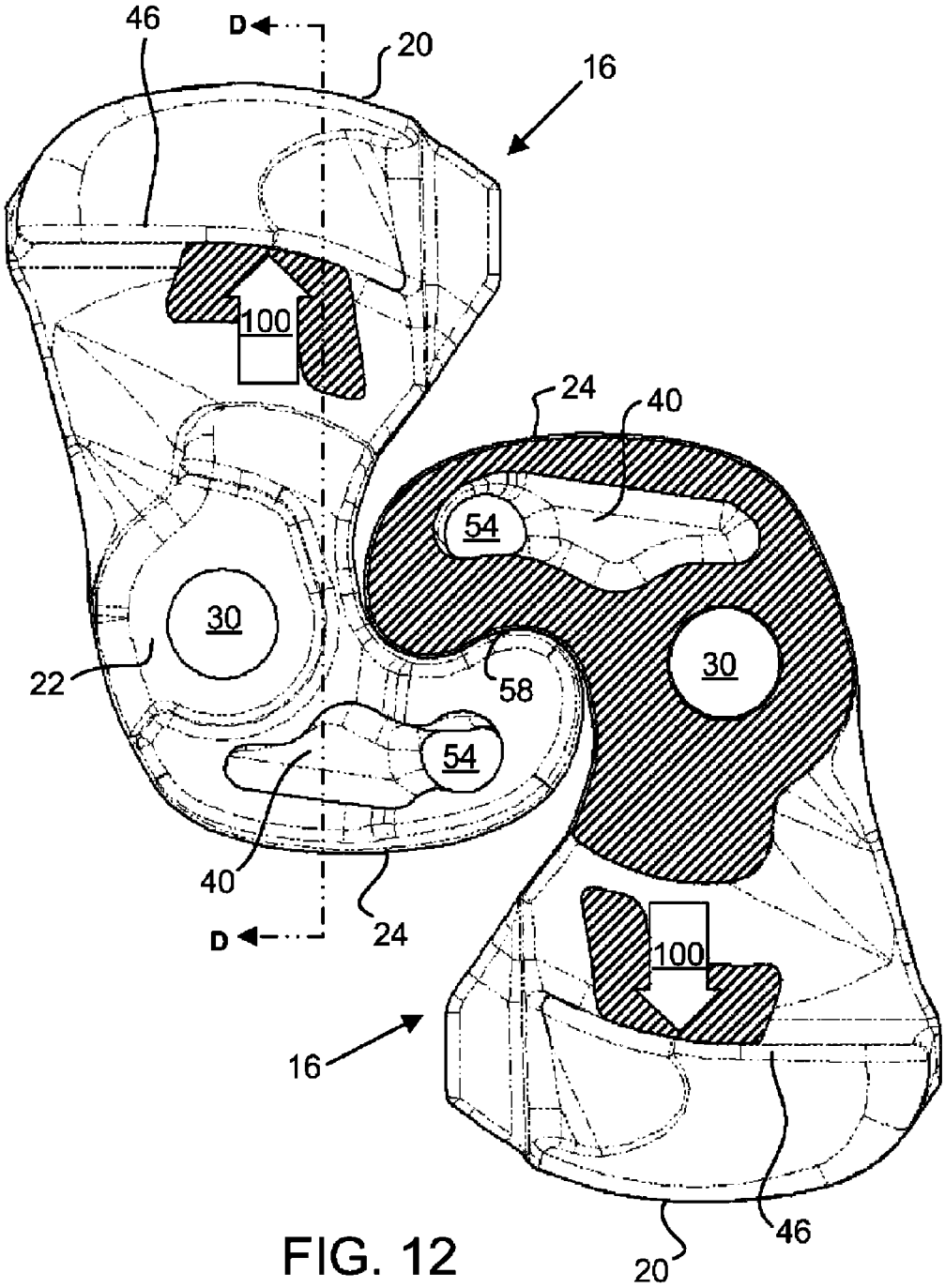
FIG. 12 is a top view of two opposing knuckles, indicating resultant forces on pulling lugs of the knuckles, and indicating a cross section view along line D-D through the length of one of the knuckles.
Figure 13:
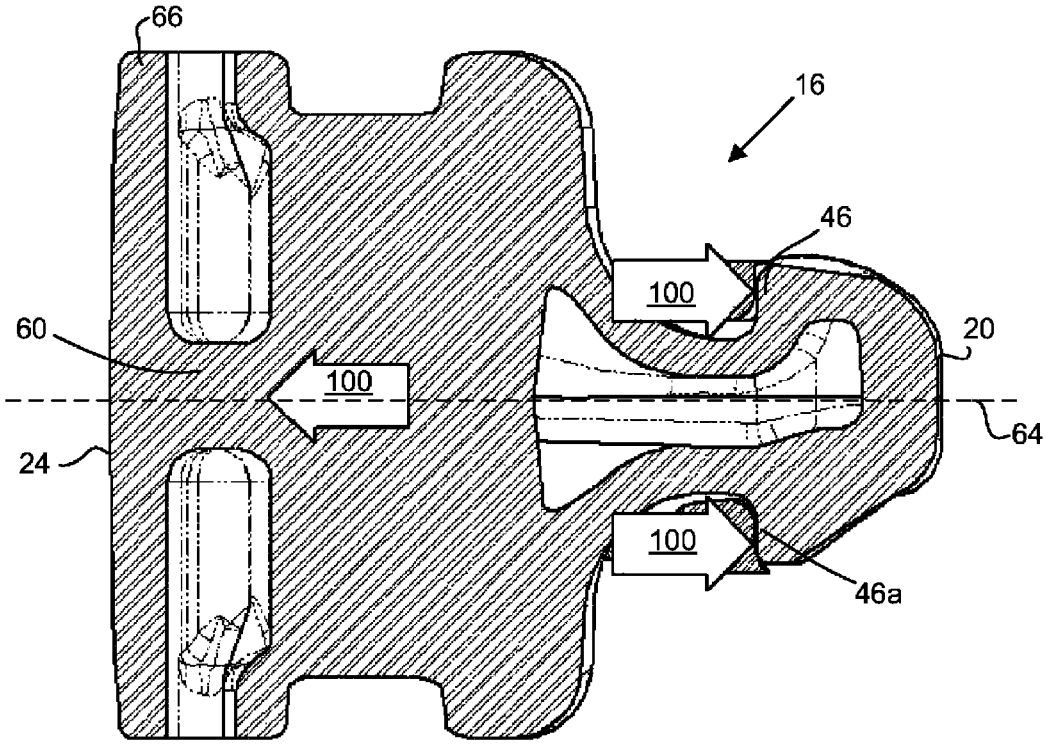
FIG. 13 is the cross section view along line D-D of FIG. 12, indicating the resultant forces from a side of the knuckle.

As shown in FIGS. 12-13, when two opposing coupler assemblies, including the knuckle 16 described above, are pulled in opposite directions by the pulling lugs 46 and **46*a*, arrows 100 indicate the resultant forces on the knuckle 16. The cope and drag molds as designed and displayed in the embodiments herein, create draft angles from the centerline 64 of the knuckle. Hence, when two knuckles are coupled together, the train line force is concentrated to the centerline of the knuckles. FIG. 13 illustrates how the centerline load is efficiently transferred through the single, thick rib 60 to the pulling lugs 46 and 46*a* of the coupler knuckle 16**.

Figure 14:
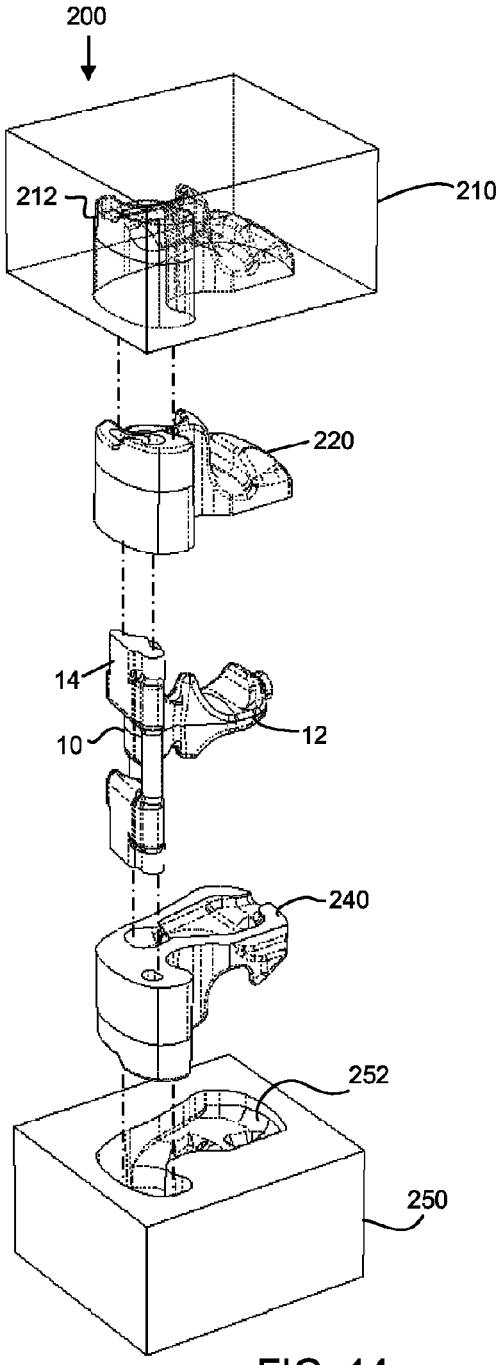
FIG. 14 is a schematic illustration of a coupler knuckle manufacturing assembly, in accordance with at least one embodiment of the knuckle of FIGS. 5-6.

FIG. 14 is a schematic illustration of a coupler knuckle manufacturing assembly 200, in accordance with at least one embodiment of the knuckle of FIGS. 1-6. The knuckle manufacturing assembly 200 includes a cope mold section 210, an upper section 220 of a coupler knuckle, the combined pivot pin and kidney core 10, 12 and the isolated finger core 14 used in the manufacturing process, a lower section 240 of the coupler knuckle, and a drag mold section 250.

The cope mold section 210 and the drag mold section 250 include mold cavities 212 and 252, respectively, into which a molten alloy is poured to cast the coupler knuckle. Mold cavities 212 and 252 are configured to correspond to the desired external surfaces of the coupler knuckle to be manufactured using cope and drag mold sections 210 and 250. The combined (first internal) pivot pin and kidney core 10, 12 is positioned with the cope or drag mold such as to be isolated from, and without contact with, the finger core 14, or second internal core. The result is that, after the molding process, molten alloy substantially separates the finger cavity 40 from the pivot pin hub section 22.

Figure 15:
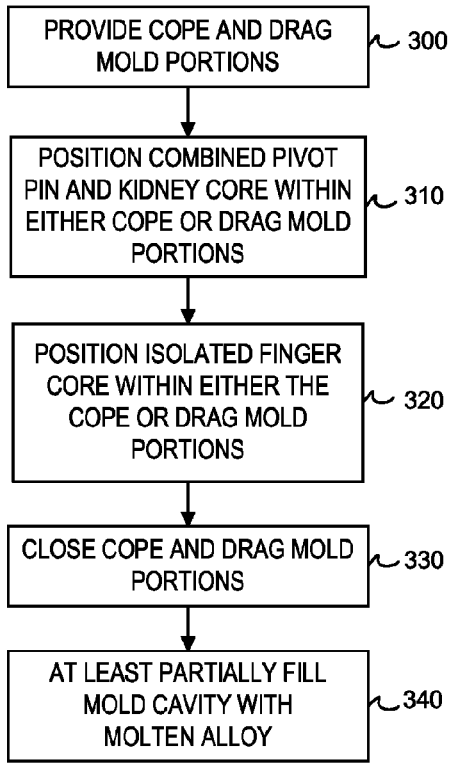
FIG. 15 is a flowchart illustrating a method for manufacturing the railcar coupler knuckle of FIGS. 5-6.

FIG. 15 is a flowchart illustrating a method for manufacturing a railcar coupler knuckle, in accordance with a particular embodiment, understanding that the upper section 220 and the lower section 240 of the coupler knuckle are not part of the assembly to cast the knuckle but a result of that casting process. The method begins at step 300 where cope and drag mold portions are provided. The cope and drag mold portions may each include internal walls, formed of sand using a pattern or otherwise, that define at least in part, perimeter boundaries of a coupler knuckle mold cavity. The mold cavity corresponds to the desired shape and configuration of a coupler knuckle to be cast using the cope and drag mold portions.

At step 310, the combined pivot pin and kidney core (first internal core) is positioned within either the cope mold portion or the drag mold portion. The first internal core is configured to define a kidney cavity and a pivot pin hub within a coupler knuckle. For example, a single core may be used that includes a pivot pin portion and a kidney portion that form the pivot pin hub and kidney cavity, respectively, but as a single void in the knuckle 16.

At step 320, the isolated finger core (second internal core) is positioned within either the cope mold portion or the drag mold portion, the second internal core to define a finger cavity. At step 330, the cope and drag mold portions are closed with the one or two internal cores therebetween using any suitable machinery. At step 340, the mold cavity including the one or two internal cores is at least partially filled, using any suitable machinery, with a molten alloy which solidifies to form the coupler knuckle.

Some of the steps illustrated in FIG. 15 may be combined, modified or deleted where appropriate, and additional steps may also be added to the flowchart. Additionally, steps may be performed in any suitable order without departing from the spirit and scope of the embodiment described therein.

The terms and descriptions used herein are set forth by way of illustration only and are not meant as limitations. Those skilled in the art will recognize that many variations can be made to the details of the above-described embodiments without departing from the underlying principles of the disclosed embodiments. For example, the steps of the method need not be executed in a certain order, unless specified, although they may have been presented in that order in the disclosure. The scope of the invention should, therefore, be determined only by the following claims (and their equivalents) in which all terms are to be understood in their broadest reasonable sense unless otherwise indicated.

The invention claimed is:

1. A railroad coupler knuckle defining an isolated finger cavity having no more than a single, solid rib at a horizontal centerline of the knuckle that passes through a pivot pin hub thereof, wherein the single, solid rib extends generally from a flag hole of the finger cavity of the knuckle to an opposite side of the finger cavity from the flag hole.

2. The railroad coupler knuckle of claim 1, wherein the single, solid rib comprises dimensions of about 1.5" thick, about 1.9" deep, and about 3.6" long.

3. A railcar coupler knuckle, comprising:

a tail section, a hub section, and a nose section;

the tail, hub, and nose sections defining internal cavities comprising (i) a combined void that defines a pivot pin hub cavity and a kidney cavity and (ii) an isolated finger cavity;

the combined void formed using a first internal core during manufacturing of the coupler knuckle;

the finger cavity formed using a second internal core during manufacturing of the coupler knuckle, such that molten alloy substantially separates the combined void and the finger cavity that is isolated from the combined void; and a single, thick rib formed from the second internal core within the finger cavity at a horizontal centerline of the knuckle that passes through the pivot pin hub, wherein the single, thick rib extends from a flag hole of the finger cavity of the knuckle to an opposite side of the finger cavity from the flag hole.

4. The railcar coupler knuckle of claim 3, wherein the second internal core comprises a large finger core footprint having a cross section of approximately 1.6 inches in depth and 4.3 inches in length.

5. The railcar coupler knuckle of claim 3, wherein the first internal core comprises a combined pivot pin and kidney core.

6. The railcar coupler knuckle of claim 3, wherein the single, thick rib comprises dimensions of about 1.5" thick, about 1.9" deep, and about 3.6" long.

7. The railcar coupler knuckle of claim 3, wherein the single, thick rib is also solid, continuous, and uninterrupted.

* * * * *